United States Patent [19]

Joly

[11] Patent Number: 4,920,867

[45] Date of Patent: May 1, 1990

[54] CHIMNEY SCREEN

[76] Inventor: Danforth O. Joly, 46 Paddocks Path, Dennis, Mass. 02638

[21] Appl. No.: 246,264

[22] Filed: Sep. 19, 1988

[51] Int. Cl.[5] ..... F23L 17/12

[52] U.S. Cl. ..... 98/67; 55/505

[58] Field of Search ..... 55/505; 98/67; 110/119, 110/121; 160/127, 369, 371

[56] References Cited

U.S. PATENT DOCUMENTS

| | | | |
|---|---|---|---|
| 399,594 | 3/1889 | Wright | 98/67 |
| 509,892 | 12/1893 | Gray | 110/119 |
| 614,932 | 11/1898 | Carper | 110/119 |
| 1,854,160 | 4/1932 | Baird | 55/505 |
| 2,976,796 | 3/1961 | Anthony et al. | 98/67 |
| 3,307,337 | 3/1967 | Freitas, Jr. et al. | 55/505 X |
| 4,334,460 | 6/1982 | Simmons et al. | 98/83 |
| 4,436,021 | 3/1984 | Hisey | 98/67 |
| 4,535,686 | 8/1985 | Hisey | 98/67 |
| 4,697,500 | 10/1987 | Hisey | 98/67 |
| 4,732,078 | 3/1988 | Giumenta et al. | 98/67 |

FOREIGN PATENT DOCUMENTS

| | | | |
|---|---|---|---|
| 16487 | of 1929 | Australia | 110/119 |
| 365861 | 1/1962 | United Kingdom | 55/505 |

*Primary Examiner*—Harold Joyce

*Attorney, Agent, or Firm*—Fish & Richardson

[57] ABSTRACT

A chimney screen device for covering the open end of a chimney to prevent access into the chimney by squirrels, birds and the like includes a rigid frame sized and constructed to be disposed upon and about an exposed end of a chimney flue liner, the frame defining an opening corresponding with the open end of the chimney flue. The device further includes a mesh of metallic material attached to the frame about the opening and spanning the opening, the mesh defining a plurality of apertures of grid size selected to prevent access of squirrels, birds and the like therethrough and having open area of at least 90% for passage of hot gases from the chimney flue therethrough without significant detrimental effect upon chimney draft, and fasteners for engaging upon outer walls of the flue liner for fixing the frame upon and about the end of the chimney flue liner, with the mesh spanning the open end of the chimney flue liner. A method for covering the open end of a chimney to prevent access into the chimney by squirrels, birds and the like is also described.

6 Claims, 1 Drawing Sheet

CHIMNEY SCREEN

BACKGROUND OF THE INVENTION

This invention concerns devices for preventing entry of squirrels and other animals into a chimney flue.

It is common to prevent access of birds, squirrels and similar animals, and of large leaves and twigs, into a chimney flue by placing sheets of screening or wire cloth material over the top of the chimney flue, and attaching it by any available means.

Other animal entry preventing devices include a chimney cap described in Wright U.S. Pat. No. 399,594 having a main lower plate sized to fit exactly upon the chimney, with a flange placed within the chimney opening. A hood attached to the plate has holes which allow escape of smoke, and the hood is surrounded by a flange which works in combination with the plate to funnel water from the chimney opening. Giumenta et al. U.S. Pat. No. 4,732,078 describes a chimney cap consisting of a housing having four sides formed from a single blank of perforated sheet material, and an overhanging roof. The cap is sized to be disposed over a chimney flue liner and attached by means of threaded bolts. Simmons et al. U.S. Pat. No. 4,334,460 and Hisey U.S. Pat. No. 4,436,021, U.S. Pat. No. 4,535,686 and U.S. Pat. No. 4,697,500 generally describe chimney caps attached by means of retention members extending into the chimney opening and consisting a housing having four sides of screen cloth or the like and a solid roof.

SUMMARY OF THE INVENTION

According to the inventoion, a chimney screen device for covering the open end of a chimney to prevent access into the chimney by squirrels, birds and the like, comprises a rigid frame sized and constructed to be disposed upon and about an exposed end of a chimney flue liner, the frame defining an opening corresponding with the open end of the chimney flue, a mesh of metallic material attached to the frame about the opening and spanning the opening, the mesh defining a plurality of apertures of grid size selected to prevent access of squirrels, birds and the like therethrough, and the mesh having open area of at least 90% for passage of hot gases from the chimney flue therethrough without significant detrimental effect upon chimney draft, and means for engaging upon outer walls of the flue liner for fixing the frame and upon and about the end of the chimney flue liner, with the mesh spanning the open end of the chimney flue liner.

In preferred embodiments, the mesh is formed of expanded metal; the means comprise threaded means; the open area of the grid is at least about 90%; and the grid size of the mesh is about ½ inch by 1 inch.

According to another aspect of the invention, a method for covering the open end of a chimney to prevent access into the chimney by squirrels, birds and the like comprises providing the chimney screen device described above; positioning the device with the frame disposed upon and about the exposed end of a chimney flue liner, and the mesh spanning the open end of the chimney flue; and fastening the device to the chimney flue liner by causing the means to engage outer walls of the flue liner to fix the frame upon and about the end of the chimney flue liner, with the mesh spanning the open end of the chimney flue liner.

The invention thus provides a chimney screen device adapted for use upon any of a variety of chimneys, which need not be custom-made for any particular chimney. The opening in the frame is covered by a wide mesh screen which does not significantly interfere with the functioning of the flue, namely, the pulling of hot gases through the chimney, but yet prevents squirrels, birds, raccoons, and other like animals from entering the flue and building nests when the chimney is not in use. The screen also prevents large leaves, twigs and other debris from entering the chimney flue.

Other features and advantages of the invention will be apparent from the following description of a presently preferred embodiment, and from the claims.

DESCRIPTION OF THE PREFERRED EMBODIMENT

The drawings will first briefly be described.

DRAWINGS

STRUCTURE

Figure 1:
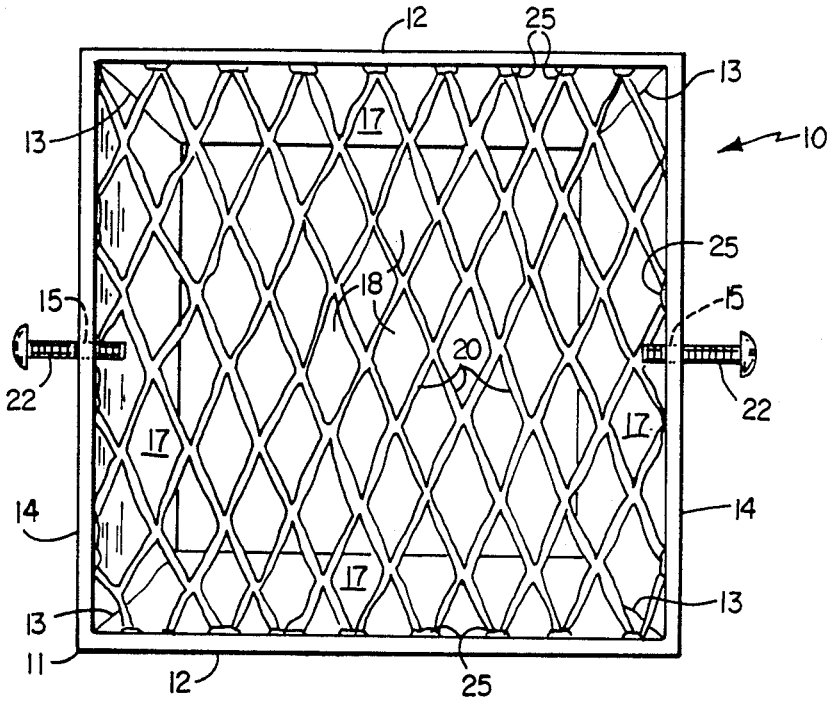
FIG. 1 is a bottom plan view of a chimney screen of the invention.
Figure 2:
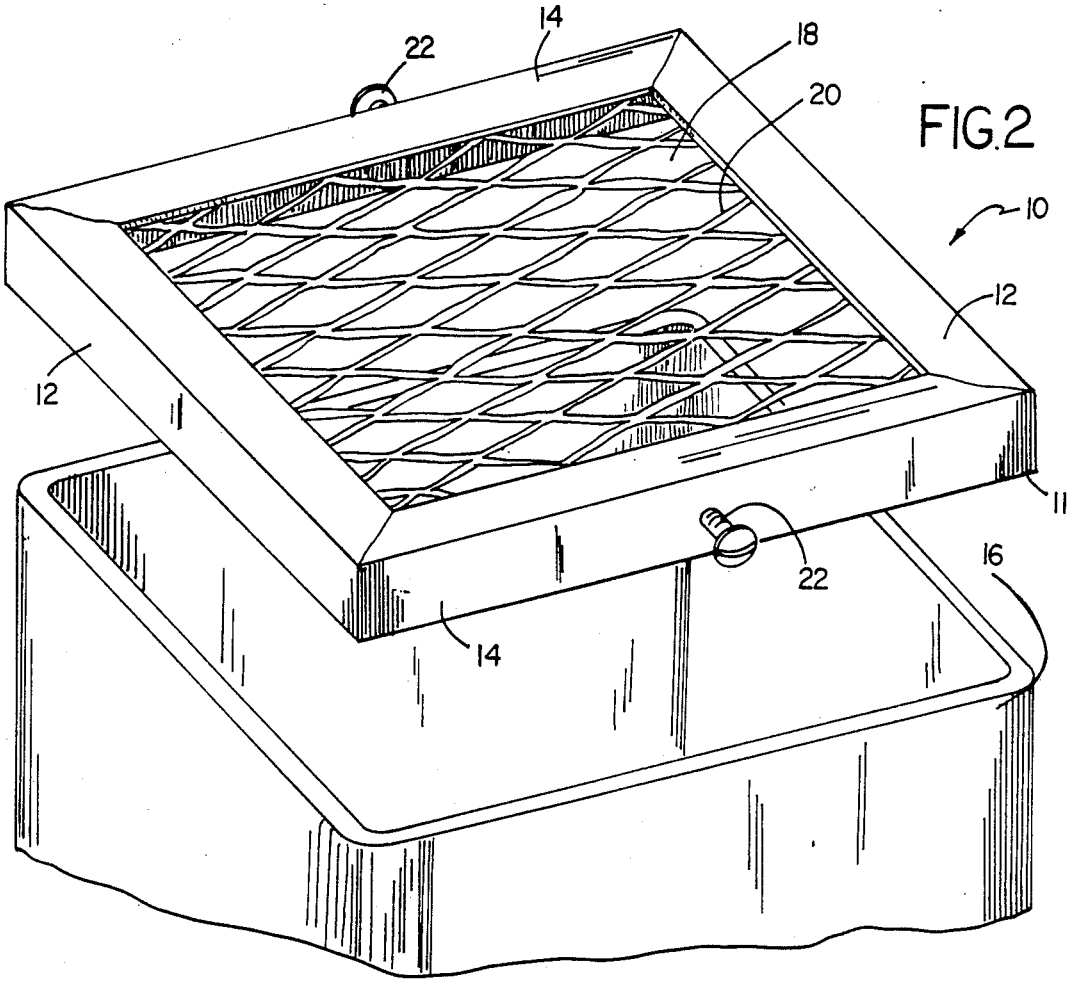
FIG. 2 is an isometric view of the chimney screen of FIG. 1 positioned over a chimney flue.

Referring to the Figures, chimney screen device 10 is formed of a square metal frame 11, formed of four aluminum angle bars 12 and 14, e.g. ¼ inch by 1½ inches by 1½ inches by 9 inches long. The four bars 12, 14 are welded together at weld positions 13. Screen device 10 fits over a standard chimney flue liner 16, of dimension about 8 inches by 8 inches square. Frame 11 defines an opening 18 of size about 7½ inches by 7½ inches square. Opening 18 is covered with expanded wire mesh 20, e.g. also of aluminum, of grid size selected to provide openings sufficiently small to prevent access of squirrels, birds and the like, yet having sufficient open area so as not to restrict proper draft, e.g., the openings are about ½ inch by 1 inch and the open area is at least about 90%. Mesh 20 is welded to frame 11 at weld points 25 to rigidly fix mesh 20 against the lower surface 17 of frame 11. Screws 22 extend through sides 14 of frame 11, through threaded apertures 15, for attachment of chimney screen device 10 to chimney flue liner 16.

USE

In use, to prevent access of squirrels, birds and the like into a chimney, a chimney screen device 10 of the invention, sized to fit any standard size chimney flue liner, is provided. To install screen device 10, screws 22 are unthreaded. The chimney screen device 10 is placed over the open end of a flue liner 16. Once the screen device 10 is in position, resting upon the open end of the flue liner, with the screen spanning the opening and the frame disposed upon and about the end of the flue liner, screws 22 are tightened until screen device 10 is rigidly fixed upon the chimney. Once the screen device 10 is in position, animals such as raccoons and squirrels and birds are unable to dislodge the screen device 10, or to enter the chimney. The screen device also acts to prevent access to the flue by large leaves and twigs. On the other hand, chimney draft is not affected adversely.

Other embodiments are within the following claims. For example, the screen device may be of any size and dimension to fit upon and about a correspondingly sized and dimensioned standard chimney flue liner.

I claim:

1. A chimney screen device of low profile for covering the open end of a chimney to prevent access into the chimney by squirrels, birds and the like, comprising:

a rigid frame having a first, vertical portion sized and constructed to be disposed about an exposed end of a chimney flue liner, and having a second, horizontal portion sized and constructed to be disposed in engagement upon an exposed end of a chimney flue liner and defining an opening of horizontal extent adapted to correspond with the open end of the chimney flue, a plane mesh of metallic material attached to said frame about said opening and spanning said opening, said mesh defining a plurality of apertures of grid size selected to prevent access of squirrels, birds and the like therethrough, and said mesh having open area of at least 90% for passage of hot gases from the chimney flue therethrough without significant detrimental effect upon chimney draft, and means for engaging upon outer surfaces of the flue liner for fixing said frame upon and about the end of the chimney flue liner, said mesh being horizontally disposed to span the open end of the chimney flue liner in close proximity with the end of the chimney flue liner.

2. The chimney screen device of claim 1 wherein said mesh is formed of expanded metal.

3. The chimney screen device of claim 1 wherein said means comprises threaded means.

4. The chimney screen device of claim 1 wherein the open area of said grid is at least about 90%.

5. The chimney screen device of claim 1 wherein the grid size of said mesh is about ½ inch by 1 inch.

6. A method for covering the open end of a chimney to prevent access into the chimney by squirrels, birds and the like, comprising:

(a) providing a chimney screen device of low profile comprising a rigid frame having a first, vertical portion sized and constructed to be disposed about an exposed end of a chimney flue liner and having a second, horizontal portion sized and constructed to be disposed in engagement upon an exposed end of a chimney flue liner and defining an opening of horizontal extent adapted to correspond with the open end of the chimney flue, a plane mesh of metallic material attached to said frame about said opening and spanning said opening, said mesh defining a plurality of apertures of grid size selected to prevent access of squirrels, birds and the like therethrough, and said mesh having open area of at least 90% for passage of hot gases from the chimney flue therethrough without significant detrimental effect upon chimney draft, and means for engaging upon outer surfaces of the flue liner for fixing said frame upon and about the end of the chimney flue liner, with said mesh disposed to span the open end of the chimney flue liner;

(b) positioning said chimney screen device of low profile with said frame portions disposed upon and about the exposed end of a chimney flue liner, and the mesh horizontally spanning the open end of the chimney flue in close proximity with the end of the chimney flue liner; and (c) fastening said device to the chimney flue liner by causing said means to engage outer surfaces of said flue liner to fix said chimney screen device upon and about the end of the chimney flue liner.

* * * * *